US007261185B2

(12) United States Patent
Strebel et al.

(10) Patent No.: US 7,261,185 B2
(45) Date of Patent: Aug. 28, 2007

(54) EQUIPMENT FOR FINE POSITIONING OF A CAR OF A MULTI-STAGE CAR

(75) Inventors: René Strebel, Merenschwand (CH); René Hoffmann, Steinhausen (CH); Urs Schaffhauser, Root (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/081,220

(22) Filed: Mar. 16, 2005

(65) Prior Publication Data

US 2005/0217941 A1 Oct. 6, 2005

(30) Foreign Application Priority Data

Mar. 17, 2004 (EP) ..... 04006289

(51) Int. Cl.
*B66B 9/00* (2006.01)

(52) U.S. Cl. ..... 187/249; 187/291; 254/122; 248/277.1

(58) Field of Classification Search ..... 187/249, 187/291, 414; 52/109; 242/277.1; 414/589; 254/9, 122, 126; 248/277.1; *B66B 9/00, B66B 1/42*

See application file for complete search history.

(56) References Cited

U.S. PATENT DOCUMENTS

| | | | | |
|---|---|---|---|---|
| 1,365,252 | A * | 1/1921 | Langill | 187/269 |
| 1,609,333 | A * | 12/1926 | Vesely | 254/126 |
| 1,914,128 | A * | 6/1933 | James et al. | 187/249 |
| 1,982,642 | A * | 12/1934 | Curok | 254/122 |
| 3,982,718 | A * | 9/1976 | Folkenroth et al. | 248/421 |
| 4,941,797 | A * | 7/1990 | Smillie, III | 414/462 |
| 5,907,136 | A * | 5/1999 | Hongo et al. | 187/277 |
| 6,161,652 | A | 12/2000 | Kostka et al. | |
| 6,334,511 | B1 | 1/2002 | Araki | |
| 6,464,205 | B2 * | 10/2002 | Wanner | 254/122 |
| 6,802,396 | B2 * | 10/2004 | Naitoh | 187/401 |
| 2003/0024772 | A1 | 2/2003 | Naitoh | |
| 2003/0164266 | A1 | 9/2003 | Gallati et al. | |

FOREIGN PATENT DOCUMENTS

| | | |
|---|---|---|
| EP | 0 870 716 | 10/1998 |
| EP | 0 933 323 | 8/1999 |
| EP | 1 357 075 | 10/2003 |
| JP | 4223935 | 8/1992 |
| JP | 04223985 A * | 8/1992 |
| JP | 9235080 | 9/1997 |
| JP | 10279232 | 10/1998 |
| JP | 2001322774 | 11/2001 |
| JP | 2002087716 | 3/2002 |

* cited by examiner

*Primary Examiner*—Gene O. Crawford
*Assistant Examiner*—Stefan Kruer
(74) *Attorney, Agent, or Firm*—Fraser Clemens Martin & Miller LLC; William J. Clemens

(57) ABSTRACT

A multi-stage elevator car has equipment for fine positioning of the cars wherein the car thresholds are positionable at the level of the floor thresholds. The fine positioning adjusting equipment operates on the principle of a double lever and moves a car frame along a path (Δz).

15 Claims, 6 Drawing Sheets

EQUIPMENT FOR FINE POSITIONING OF A CAR OF A MULTI-STAGE CAR

BACKGROUND OF THE INVENTION

The present invention relates to equipment for fine positioning a car of a multi-stage car for an elevator, wherein the thresholds of the cars are positionable at the level of the floor thresholds.

An elevator with a multi-stage car is shown in the European patent specification EP 0 870 716, consisting of a main frame in which two cars are arranged. A pantograph operating on the scissors principle centrally engages at an intermediate yoke. One end of the pantograph is pivotably connected with the lower yoke of the upper car and the other end of the pantograph is pivotably connected with the upper yoke of the lower car. Two spindle drives are provided at the upper yoke of the main frame and move the upper car up and down. In the case of upward movement of the upper car, the pantograph extends, whereby the lower car executes a downward movement. In the case of downward movement of the upper car, the pantograph contracts, whereby the lower car executes an upward movement.

A disadvantage of this known equipment resides in the fact that the pantograph engaging the intermediate yoke loads the intermediate yoke with two cars. Moreover, a comprehensive control is required for fine positioning of the cars with car movement in opposite sense.

SUMMARY OF THE INVENTION

The present invention avoids the disadvantages of the known equipment and creates adjusting equipment which is of simple construction.

The advantages achieved by the present invention are that with this adjusting equipment a doubled lever translation can be executed, which in turn enables a smaller adjusting drive. Of further advantage is the fact that the adjusting equipment according to the present invention has a more linear force path. The adjusting mechanism can be mounted laterally of the car, whereby the intermediate yoke is loaded only by one car. The forces are introduced directly into side panels. The drive arranged below the car has a lesser space requirement. No adjusting equipment is necessary for the further car and thus also no car guide is required.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
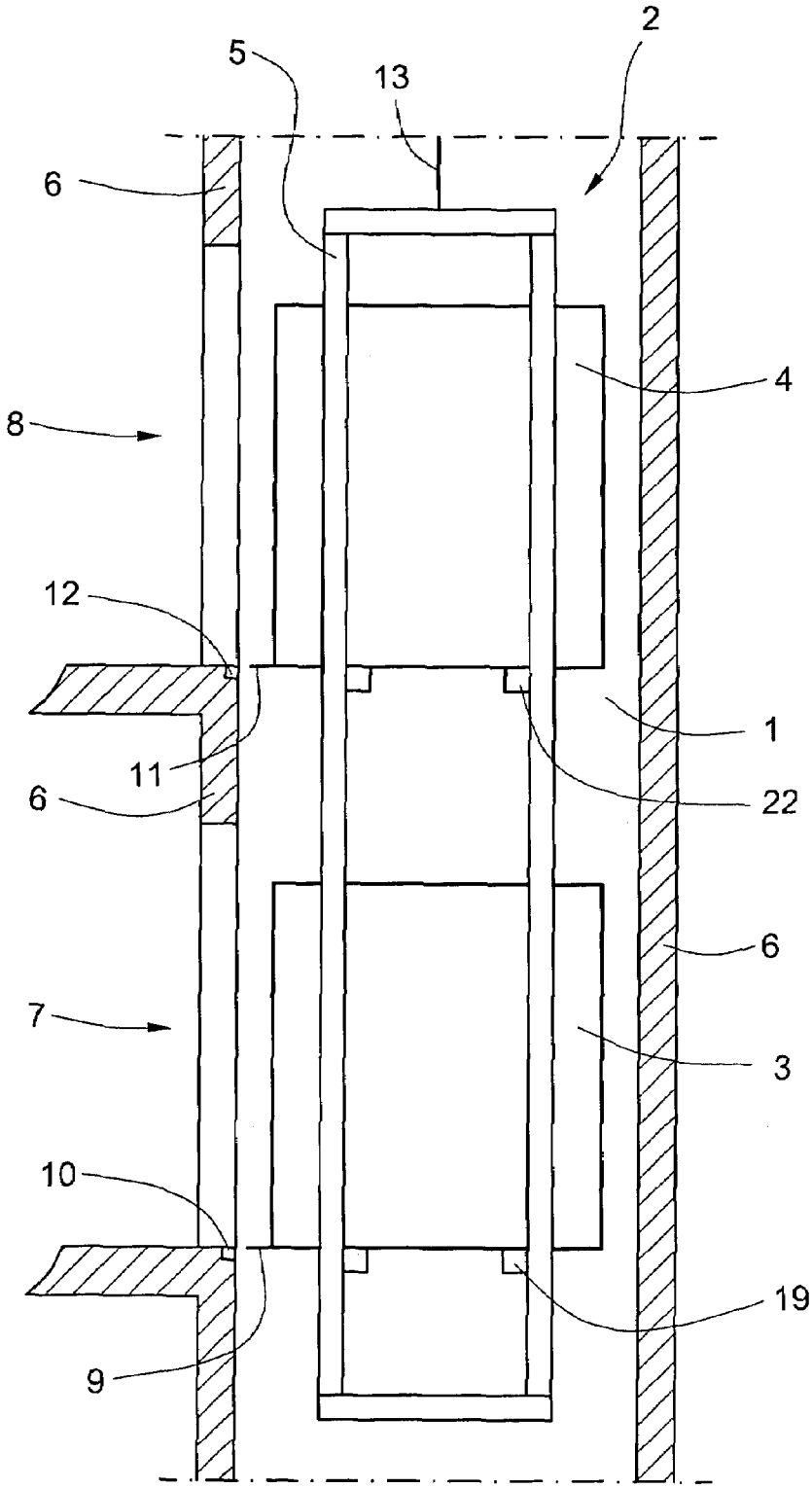
FIG. 1 is a schematic cross-sectional elevation view of a multi-stage car which is movable in an elevator shaft and which consists of a lower car and an upper car.

FIG. 1 shows a multi-stage car 2 which is movable in an elevator shaft 1 and which consists of a lower car 3 and an upper car 4, which cars are arranged in a main frame 5. The elevator shaft 1 is formed from shaft walls 6, wherein an opening which serves for access to the multi-stage car 2 and which is closed by a floor door (not illustrated) is provided for each floor. The openings of the elevator cars 3, 4 are closed by car doors (not illustrated). An uneven-numbered floor is denoted by 7 and an even-numbered floor by 8. The lower car 3 stands at the uneven-numbered floor 7 and the upper car 4 stands at the even-numbered floor 8. After positioning of the lower car 3 a car threshold 9 is flush in terms of level with a floor threshold 10. After positioning of the upper car 4 a car threshold 11 is flush in terms of level with a floor threshold 12. The drive for the multi-stage car 2 is not illustrated, wherein supporting and driving means, for example cables 13, are guided over a drive pulley. A counterweight (not illustrated) is provided as weight compensation for the multi-stage car 2.

Figure 2:
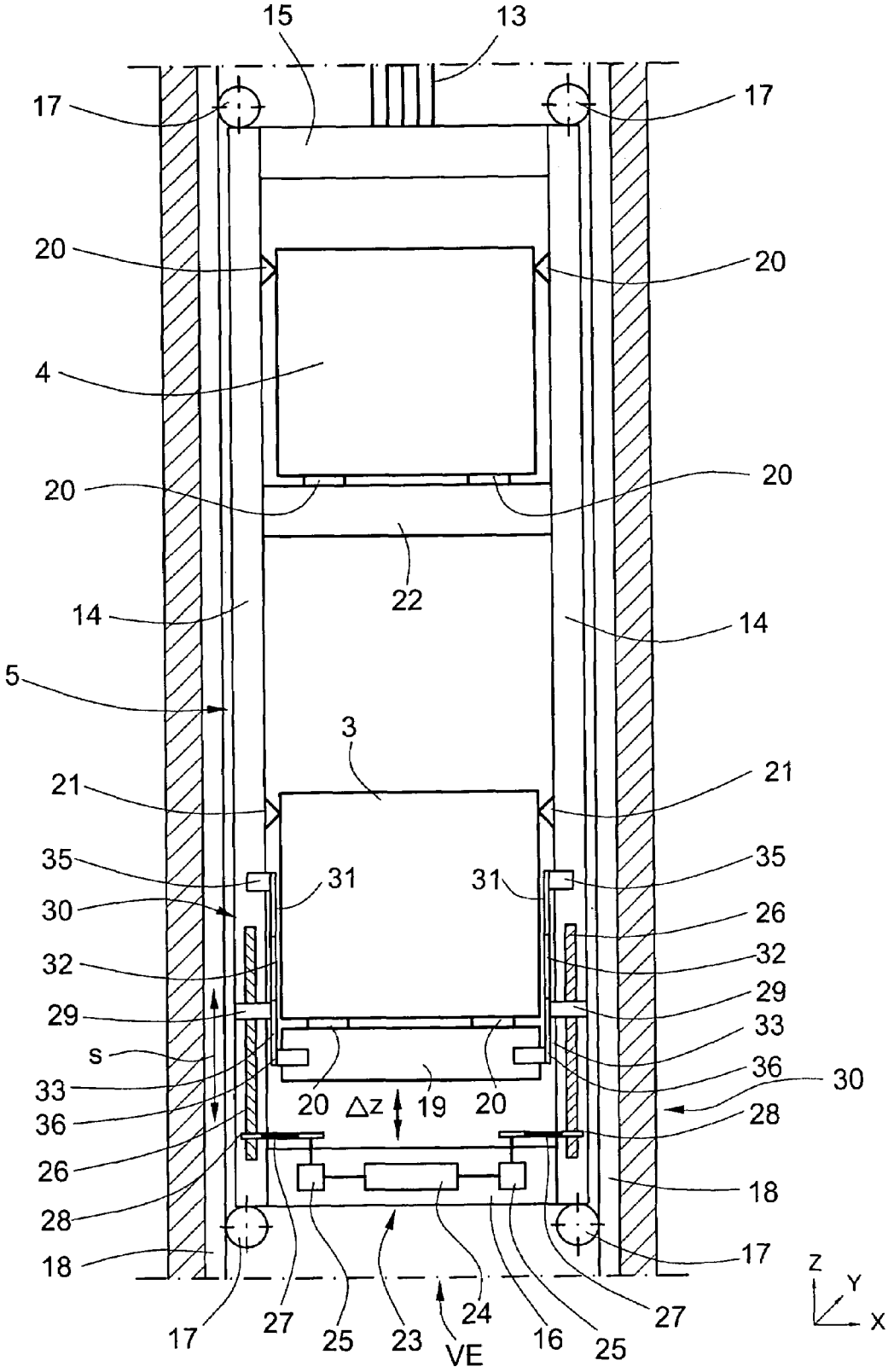
FIG. 2 is a view similar to FIG. 1 showing the multi-stage car with adjusting equipment according to the present invention for the lower car.

FIG. 2 shows the multi-stage car 2 with adjusting equipment VE according to the present invention for the car 3. The main frame 5 consisting of side panels 14, an upper yoke 15 and a lower yoke 16 is guided by means of roller guide shoes 17 along guide rails 18 arranged in the elevator shaft 1 and is carried by the cables 13. The lower car 3 is mounted to be standing by means of car mounts 20 on a car frame 19. The car 3 is guided by means of car guides 21 at the side panels 14. The upper car 4 is mounted to be standing by means of car mounts 20 on an intermediate frame 22 and on the side panels 14. The cars 3, 4 can also be self-supporting cars or open cars without separate car frames.

A drive 23 consisting of motor 24 and gear 25 is arranged at the lower yoke 16 of the main frame 5, wherein the movement of the gear output is transmitted per side panel 14 by means of, for example, belts 27 to a threaded spindle 26, which is arranged centrally at the main frame 5, with a pulley 28. A threaded nut 29 of the threaded spindle 26 can move along the path s symbolized by means of arrows, wherein a lever mechanism 30 disposed in connection with the threaded nut 29 raises or lowers the car frame 19 along the path $\Delta z$ symbolized by means of arrow. Lever mechanism 30 and threaded spindle 26 are laterally arranged at both sides of the lower car 3.

The lower car 3 can be adjusted during, before or after the travel. Instead of the lower car 3, the upper car 4 can be adjustable in height. In a further variant also both cars 3, 4 can be adjustable in height independently of one another by means of adjusting mechanisms.

Figure 3:
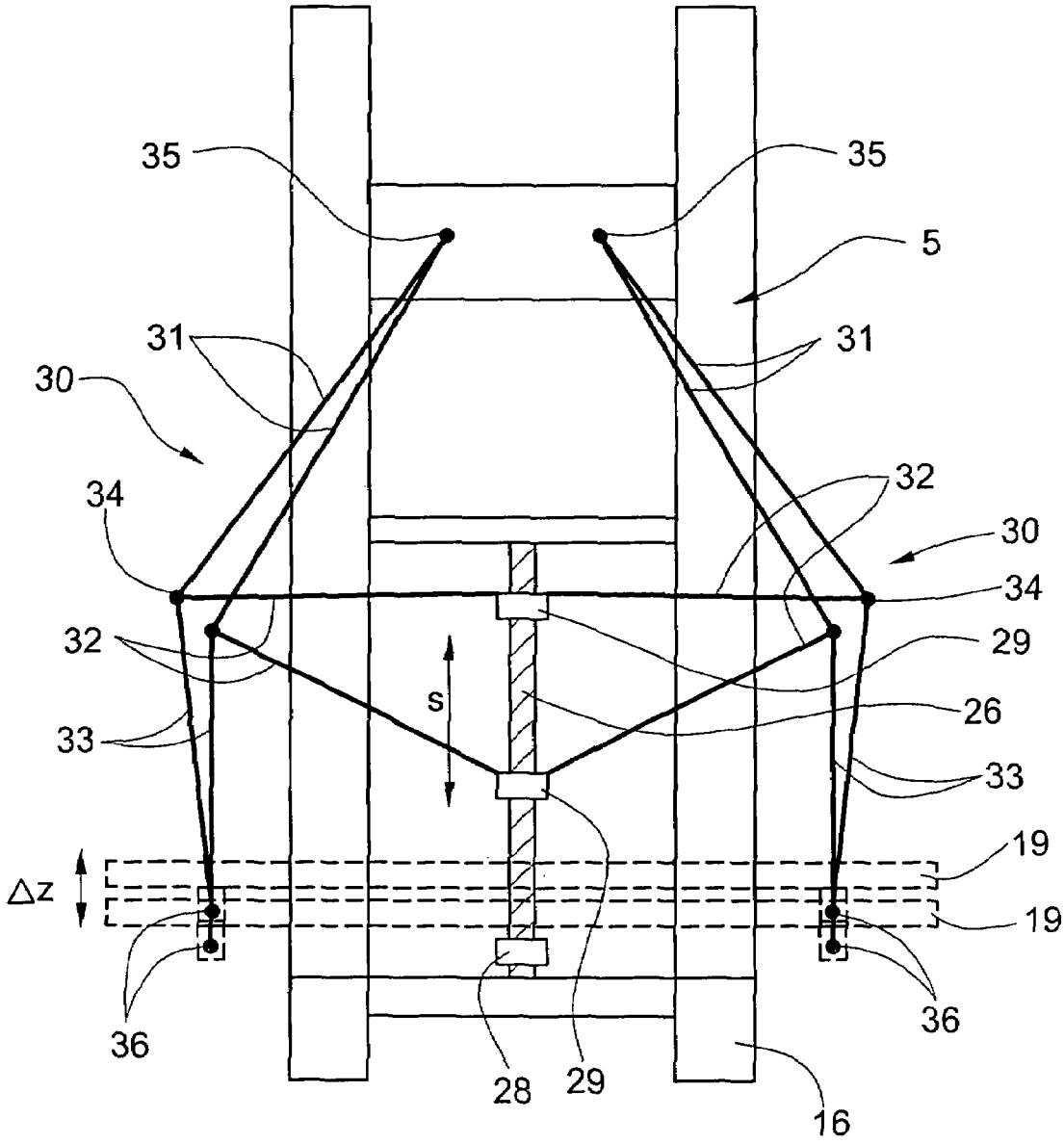
FIG. 3 is a schematic diagram of the principle of operation of the adjusting equipment shown in FIG. 2.

FIG. 3 shows the adjusting equipment VE, which operates on the principle of the double lever, for the car 3. The lever mechanism 30 is shown with the threaded nut 29 in the lower end position and with the threaded nut 29 in the upper end position, wherein the lever mechanism 30 moves the car frame 19 into the upper position or into the lower position.

The lever mechanism 30 is of symmetrical construction and each half consists of an upper lever 31, a center lever 32 and a lower lever 33. The levers 31, 32, 33 are connected together at one end by means of a joint 34. The upper lever 31 is pivotably connected at the other end at a bearing point 35 with the main frame 5. The center lever 32 is pivotably connected at the other end with the threaded nut 29. The lower lever 33 is pivotably connected at the other end with the car frame 19 at a bearing point 36.

Thanks to the symmetrical arrangement of the lever mechanism 30, no moments act in an "X" and/or a "Y" direction. Moreover, an approximately constant force course is achieved along the path Δz by the lever mechanism 30.

Figure 4:
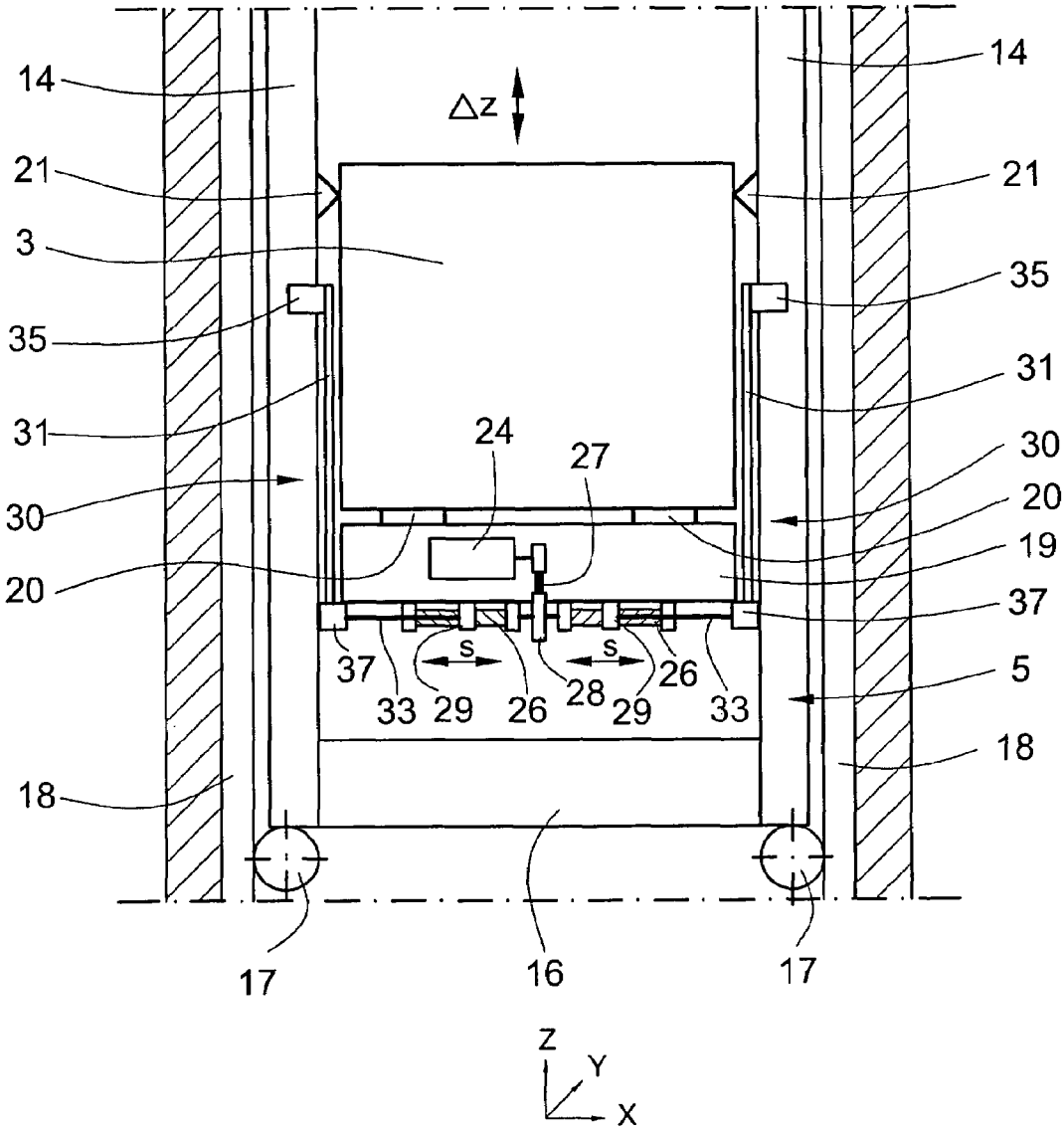
FIG. 4 is a view similar to FIG. 2 showing the lower car and an alternate embodiment of the adjusting equipment according to the present invention.

FIG. 4 shows adjusting equipment VE with threaded spindles 26 arranged at the car frame 19 or with a left-hand threaded spindle 26 and a right-hand threaded spindle 26. The lower lever 33 is pivotably connected at one end with the threaded nut 29 and pivotably connected at the other end with a connecting member 37. The upper lever 31 is pivotably connected at one end with the connecting member 37 and at the other end with the bearing point 35 of the main frame 5. The movement, which takes place in the horizontal plane, of the lower lever 33 is converted into the movement of the upper lever 31 taking place in the vertical plane.

Figure 5:
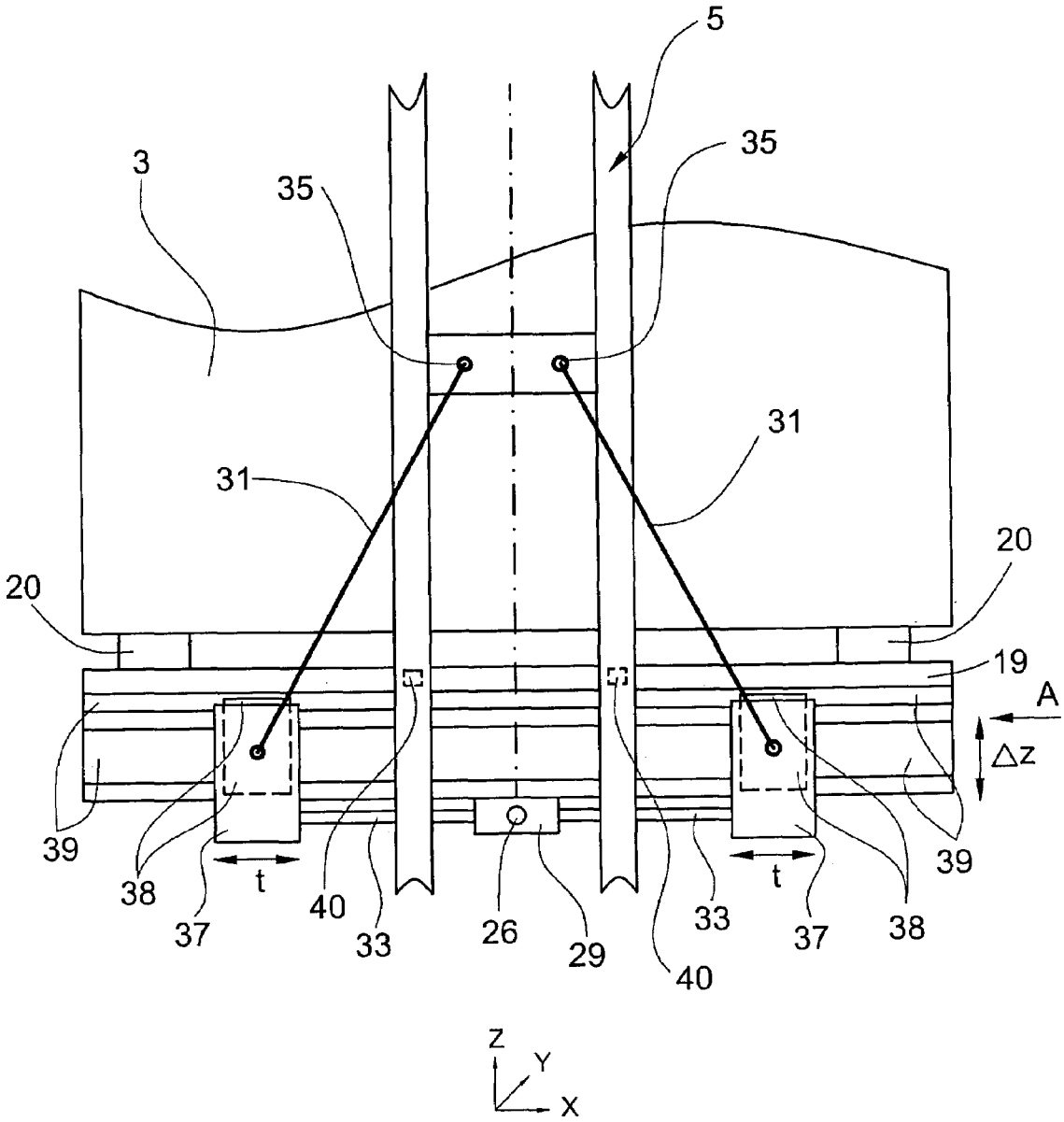
FIG. 5 is an enlarged schematic diagram showing details of the adjusting equipment shown in FIG. 4.
Figure 6:
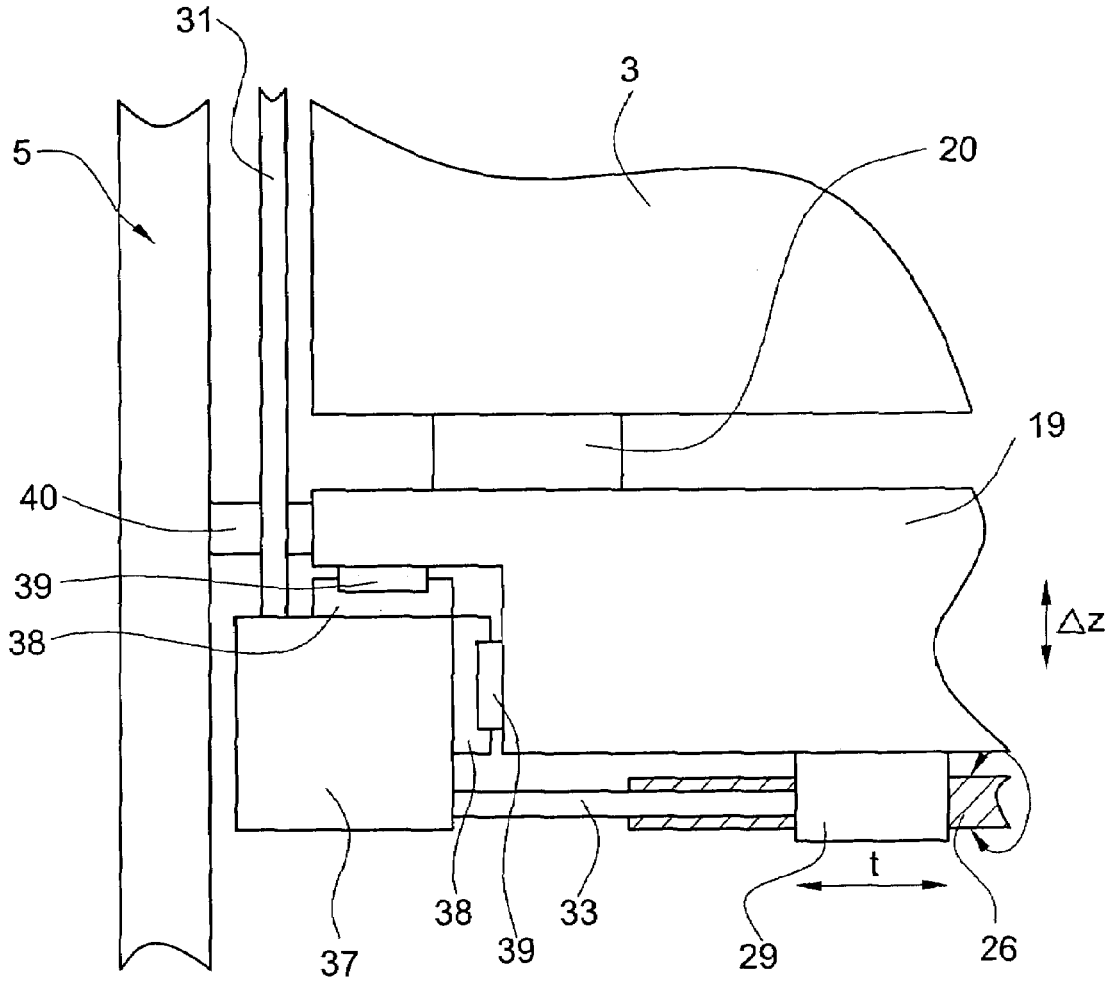
FIG. 6 is a view taken in the direction of the arrow "A" of FIG. 5.

FIG. 5 and FIG. 6 show details of FIG. 4. FIG. 6 shows the view "A" of FIG. 5. The connecting member 37 is arranged at a slide 38 which is guided in a linear guide 39 of the car frame 19. The travel t of the slide 38 is converted by means of the upper lever 31, which is pivotably mounted at the bearing point 35, into the travel Az of the car frame 19. The car frame 19 is laterally guided at the main frame 5 by means of sliding guides 40.

The adjusting equipment VE comprises two lever systems acting in series. In FIGS. 2 and 3, the first lever system includes the spindle 26, the nut 29 and the lever 32 and the second lever system includes the lever 31 and the lever 33. In FIGS. 4-6, the first lever system includes the spindle 26, the nut 29 and the lever 33 and the second lever system includes the connecting member 31 and the lever 31. In each system, the first lever system activates the second lever system.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An equipment for fine positioning cars of a multi-stage car for an elevator, wherein car thresholds of the cars are positionable at a level of floor thresholds, comprising:

adjusting equipment including first and second lever systems connected between one of the cars and a main frame of the multi-stage car for fine positioning of the one car relative to the floor thresholds, a drive fixed to the main frame for driving said first lever system, said first lever system being connected only between said drive and said second lever system and said second lever system being connected between the main frame and a car frame of the one car and wherein said first lever system drives said second lever system.

2. The equipment according to claim 1 wherein said adjusting equipment includes said drive driving a threaded spindle, said threaded spindle driving a lever mechanism moving a car frame of the one car relative to the main frame.

3. The equipment according to claim 2 wherein said lever mechanism is of symmetrical construction and each half consists of an upper lever, a center lever and a lower lever, said levers being connected together at one end at a joint and said upper and lower levers being mounted at opposite ends at separate bearing points, and said center lever being pivotably connected at an opposite end with a threaded nut of said threaded spindle.

4. The equipment according to claim 2 wherein said lever mechanism and said threaded spindle are of symmetrical construction and a first half includes a first threaded spindle, an upper lever and a lower lever, wherein said lower lever is pivotably connected at one end with a first threaded nut of said threaded spindle and pivotably connected at an opposite with said upper lever, wherein said lower lever is movable in a horizontal plane and said upper lever is movable in a vertical plane.

5. The equipment according to claim 4 including a slide connecting said lower lever with said upper lever, said slide being movable along a linear guide of the car frame, and wherein a horizontal slide movement of said slide is convened into a vertical movement of the car frame.

6. A multi-stage car for an elevator comprising:

a pair of cars arranged vertically in a main frame, at least one of said cats being mounted on a car frame vertically movable relative to said main frame; and adjusting equipment including first and second lever systems connected between said car frame and said main frame for fine positioning of said at least one car relative to floor thresholds, a drive fixed to said main frame for driving said first lever system and wherein said first lever system is connected only between said drive and said second lever system and drives said second lever system connected between said main frame and said car frame.

7. The multi-stage car according to claim 6 wherein said adjusting equipment includes said drive driving a threaded spindle, said threaded spindle driving a lever mechanism moving said ear frame relative to said main frame.

8. The multi-stage car according to claim 7 wherein said lever mechanism is of symmetrical construction and each half consists of an upper lever, a center lever and a lower lever, said levers being connected together at one end at a joint and said upper and lower levers being mounted at opposite ends at separate bearing points on said main frame and said car frame respectively, and said center lever being pivotably connected at an opposite end with a threaded nut of said threaded spindle.

9. The multi-stage car according to claim 7 wherein said lever mechanism and said threaded spindle are of symmetrical construction and a first half includes a first threaded spindle, an upper lever and a lower lever, wherein said lower lever is pivotably connected at one end with a first threaded nut of said threaded spindle and pivotably connected at an opposite with said upper lever, wherein said lower lever is movable in a horizontal plane and said upper lever is movable in a vertical plane.

10. The multi-stage ear according to claim 9 including a slide connecting said lower lever with said upper lever, said slide being movable along a linear guide of said car frame, and wherein a horizontal slide movement of said slide is converted into a vertical movement of said car frame.

11. An equipment for fine positioning cars of a multi-stage car for an elevator, wherein car thresholds of the cars are positionable at a level of floor thresholds, comprising:

adjusting equipment including first and second lever systems connected between one of the cars and a main frame of the multi-stage car for fine positioning of the one car relative to the floor thresholds, said first lever system including a threaded spindle engaging a threaded nut and a lever pivotally connected to said nut, a drive fixed to the main frame for driving said first lever system and wherein said first lever system is connected only between said drive and said second lever system and drives said second lever system connected between the main frame and a car frame of the one car.

12. The equipment according to claim 11 wherein said adjusting equipment includes said drive driving said threaded spindle to activate said first and second lever systems.

13. The equipment according to claim 11 wherein lever is a center lever and said second lever system includes an upper lever and a lower lever, said levers being connected together at one end at a joint and said upper and lower levers being mounted at opposite ends at separate bearing points.

14. The equipment according to claim 11 wherein said lever is a lower lever and said second lever system includes an upper lever and a connecting member, said lower lever being pivotably connected at one end with said nut of said treaded spindle and pivotably connected at an opposite with said upper lever, said lower lever being movable in a horizontal plane and said upper lever being movable in a vertical plane.

15. The equipment according to claim 14 including a slide connecting said lower lever with said upper lever, said slide being movable along a linear guide of the car frame, and wherein a horizontal slide movement of said slide is converted into a vertical movement of the car frame.

* * * * *